United States Patent [19]

Vermillion

[11] 4,109,342

[45] Aug. 29, 1978

[54] VACUUM CLEANER WITH BARE FLOOR CLEANING BRUSH

[75] Inventor: Don W. Vermillion, Anderson, S.C.

[73] Assignee: The Singer Company, New York, N.Y.

[21] Appl. No.: 820,177

[22] Filed: Jul. 29, 1977

[51] Int. Cl.[2] ..... A47L 5/30

[52] U.S. Cl. ..... 15/373

[58] Field of Search ..... 15/368, 371, 373

[56] References Cited

U.S. PATENT DOCUMENTS

| | | | |
|---|---|---|---|
| 2,488,625 | 11/1949 | Hallock | 15/373 |
| 4,014,068 | 3/1977 | Payne et al. | 15/373 X |

*Primary Examiner*—Christopher K. Moore

*Attorney, Agent, or Firm*—Alan Ruderman; Edward L. Bell; Robert E. Smith

[57] ABSTRACT

A vacuum cleaner having a retractable sweeper strip brush positioned within the nozzle behind the rotating agitator brush. A pinion is mounted on one end of the brush housing axle and meshes with a rack slidable in a housing in the chassis behind the nozzle. One end of the rack is connected to a connecting link having the other end eccentrically connected to a lever pivotally mounted at the rear of the cleaner chassis. The lever includes a tab which protrudes through a slot in the chassis for turning the lever to thereby pivot the brush to extend the bristles downwardly from the nozzle when cleaning bare floors and to retract the brush when cleaning carpets or the like.

3 Claims, 3 Drawing Figures

VACUUM CLEANER WITH BARE FLOOR CLEANING BRUSH

BACKGROUND OF THE INVENTION

This invention relates to vacuum cleaners and more particularly to upright vacuum cleaners or the like having a retractable bare floor cleaning brush in the rear of the suction intake nozzle.

It is conventional in upright vacuum cleaners and power nozzle attachements for canister cleaners to include a power driven rotatable agitator or beater brush mounted in the mouth of the suction nozzle for cleaning floor coverings such as carpets and rugs. The brush is mounted for movement with the nozzle between various selected nozzle heights above the floor. For high pile floor coverings the nozzle is positioned at a high elevation and for the lower pile heights the nozzle can be lowered. For cleaning bare floors the nozzle is lowered to its bottommost position. However, it has been found that even at the lowest position cleaning of uncovered or bare floors is poor apparently because of the low friction between the floor and the brush and because the chassis of the cleaner or attachment is spaced above the floor the rotating agitator brush throws debris back too fast for the air stream to carry all the debris into the nozzle mouth. This problem has been recognized in the prior art and an additional, but retractable, brush has been proposed. In the bare floor mode the brush is lowered to its lowermost position and is retracted for cleaning. One such approach is illustrated in Payne et al, U.S. Pat. No. 4,014,068 in which the brush is resiliently mounted for vertical movement.

SUMMARY OF THE INVENTION

The present invention provides a retractable bare floor cleaning sweeper or strip brush positioned within the nozzle mouth of the upright cleaner or power nozzle rearwardly of the rotating brush. The brush is supported in a housing having an axle including a gear on one end which meshes with a rack that is operatively connected to a manually rotatable crank. Rotation of the crank effects a pivoting of the brush into an operative position for cleaning bare floors and an inoperative position withdrawn into the nozzle mouth with the brush bristles disposed substantailly parallel to the nozzle mouth so as not to disrupt the air path.

Consequently, it is a primary object of the present invention to provide a sweeper or strip brush positioned within the nozzle of an upright vacuum cleaner or power nozzle behind the rotatable agitator brush for improved bare floor cleanability and which is pivotably retractable into the nozzle when cleaning covered floors.

BRIEF DESCRIPTION OF THE DRAWINGS

Other objects and advantages of this invention will best be understood upon reading the following detailed description of the invention with the accompanying drawings, in which.

DESCRIPTION OF THE PREFERRED EMBODIMENT

Figure 2:
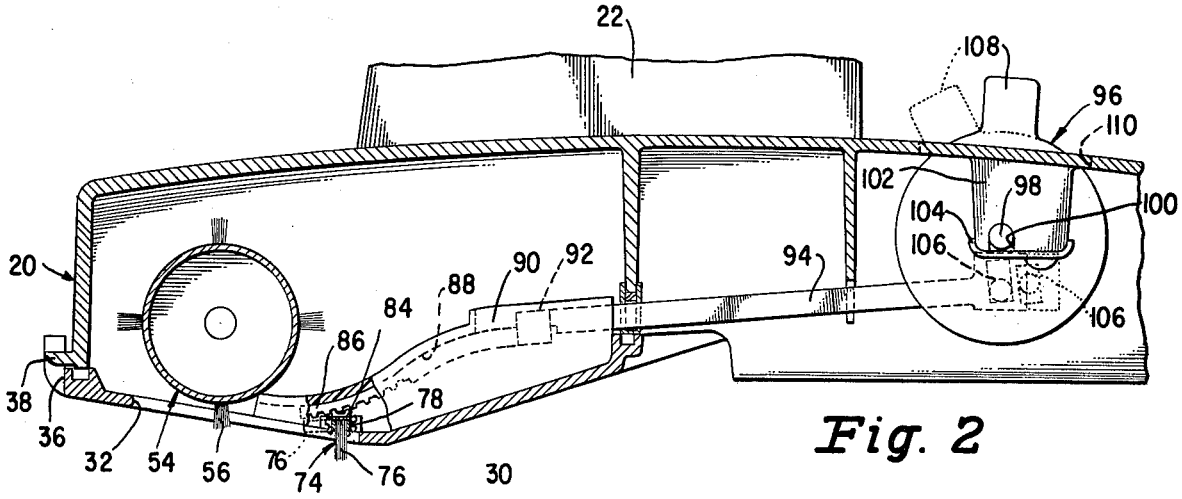
FIG. 2 is a cross sectional view through the cleaner chassis along the line 2—2 of FIG. 1 with the sweeper brush in the operative position and with the dotted line illustrating the retracted position.
Figure 1:
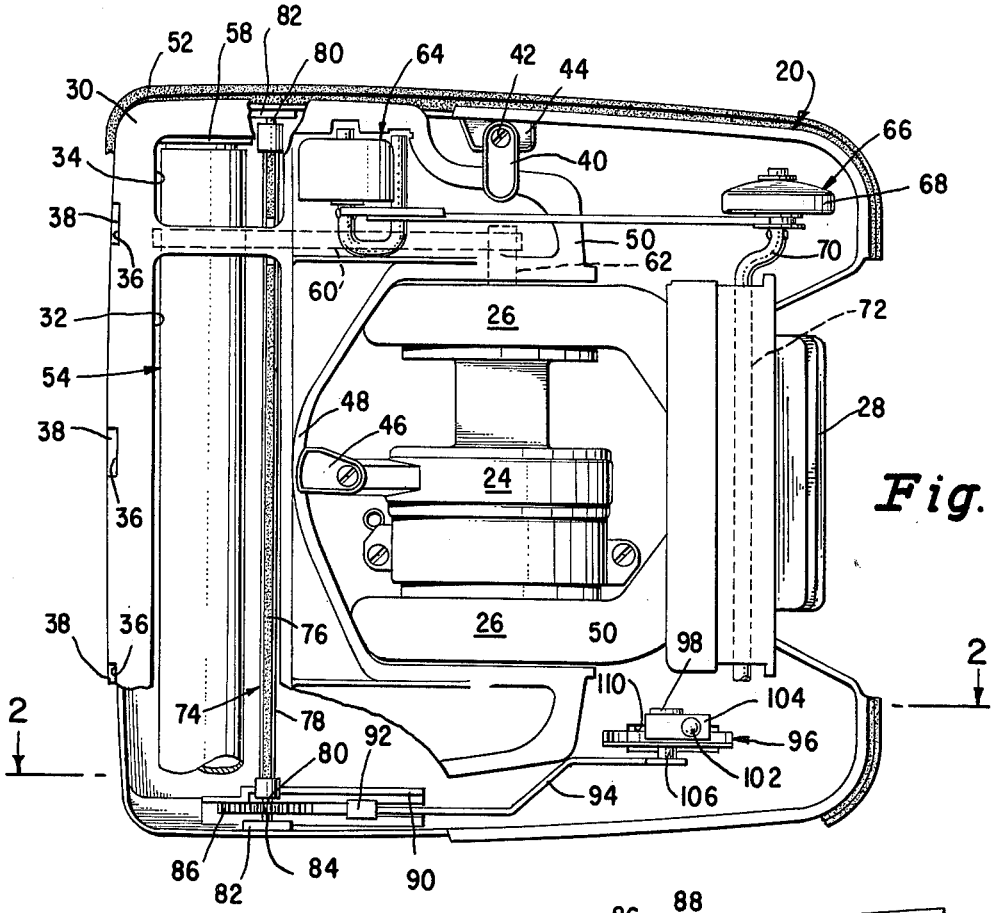
FIG. 1 is a bottom plan view of a vacuum cleaner chassis incorporating a retractable sweeper brush constructed in accordance with the present invention.
Figure 3:
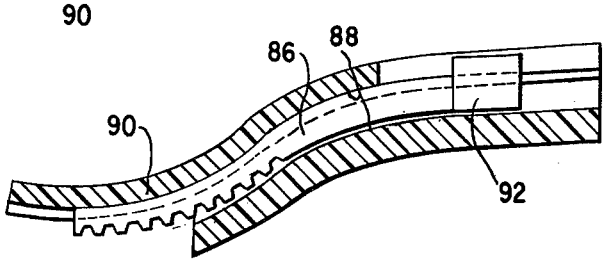
FIG. 3 is a sectional view through the rack housing.

Referring now to the drawings the invention will be described as embodied in an upright or floor type vacuum cleaner of the type described in U.S. Pat. No. 3,163,439, but it is to be understood that the invention is equally applicable to a power nozzle attachment for a canister type cleaner which is nothing more than an upright cleaner with the suction creating means remote from the nozzle inlet. Since the propelling handle and dust bag are conventional and form no part of the present invention and are not necessary for a clear understanding thereof, reference should be had to U.S. Pat. No. 3,163,439 for a disclosure thereof.

The vacuum cleaner includes a chassis 20, on the top of which is secured a hood 22. Formed in the bottom of the chassis is a central recess 24 within which is housed an electric motor (not shown), and a pair of recesses 26, 26 for housing a pair of fan impellers (not shown). The motor drives the fan impellers which communicate with a rearwardly open common discharge duct 28 to which is secured a dust bag assembly as illustrated in the aforesaid U.S. patent. An access plate 30 having a pair of apertures 32 and 34 disposed therein is releasably secured to the bottom of the chassis. The access plate 30 includes in the front edge thereof three slots 36, only two of which are illustrated, which are adapted to register with respective tabs 38 formed on the bottom leading edge of the chassis. A pair of retaining clips 40, only one of which is illustrated, pivotably secured by screws 42 to shoulders 44 on opposite sides of the bottom of the chassis, and a latch 46 on the central portion of the chassis, which cooperates with the edge 48 of the access plate, operates to secure the access plate to the chassis when the tabs 38 are in proper registration with the slots 36. The vacuum cleaner inlet nozzle, which is defined by the apertures 32 and 34, communicate with the fans by means of air passages defined between the bottom of the chassis and a pair of rearwardly extending arms 50 of the access plate to produce a suction at the nozzle inlet when the motor is in operation. A conventional rubber bumper 52 aids in sealing the access plate and chassis to minimize the suction losses between the fan and the nozzle inlet. The fan exhaust air is discharged through the duct 28 and into the dust bag in the conventional manner.

A rotary floor brush assembly 54 including a spirally disposed bristle brush 56 is mounted in the nozzle above the openings 32 and 34 and includes bearing assemblies 58 at its extremities positioned at opposite sides of the chassis so as to contact and agitate the floor surface when the cleaner is in the operative position as illustrated in FIG. 2. An endless belt 60 drives the brush assembly from a spindle 62 on the motor fan shaft.

Conventionally, the cleaner chassis supports a pair of front wheel assemblies 64 (only one of which is illustrated) and a rear wheel assembly 66 including a pair of rear wheels 68 (only one of which is illustrated) mounted on offset ends 70 of a rear axle 72 which may be raised or lowered as described in U.S. Pat. No. 3,713,185 to change the elevation of the cleaner nozzle for the proper cleaning of various floor coverings and surfaces. However, when cleaning floors with no coverings, i.e., bare floors, it is found that the cleaning capability is improved by the use of a sweeper type brush. This effect is more pronounced since the rotating agitator brush generally engages the bare floor (i.e. the agitator brush is not adjusted upwardly when the nozzle is lowered) and thus debris is thrown rearwardly by the rotary brush.

In order to overcome this disadvantage, the present invention provides a sweeper or strip brush 74 that acts as a sweeper and debris deflector on bare floors in the operative position and which can be pivotably retracted when the cleaner is used on floor coverings. The brush 74 comprises a multiplicity of bristles 76 mounted in an elongated substantially U shaped frame 78 having a spindle 80 on each end. The spindles are positioned within respective journal blocks 82 secured to the inside wall of the access plate 30 inside the nozzle intake behind the agitator brush assembly 54 so that the bristles 76 will engage the floor when extending downwardly with the nozzle in the bare floor position. Fixedly carried on one of the spindles 80 is a pinion gear 84 having a plurality of circumferentially spaced teeth. An elongated toothed rack member 86 is positioned in a channel 88 formed in a narrow housing 90 secured to the chassis with the rack 86 in mesh with the pinion 84. The rear end of the rack 86 includes a connecting block 92 to which one end of a link are 94 is secured. A lever 96 which may be in the form of a disk is pivotably journaled on a spindle 98 in the inside wall in the rear of the chassis. As illustrated, the spindle 98 may be secured to the lever 96 and positioned within a cutout 100 on a protuberance 102 of the chassis, and a plate 104 may be secured to the protuberance to journal the spindle in the cutout. The other end of the link arm 94 is pivotably and eccentrically connected by a pin 106 to the lever 96.

Preferably the lever includes an operator tab 108 which extends upwardly to an elongated slot 110 in the chassis so as to be accessible to the operator of the cleaner. Front and rear edges of the slot 110 act as stops for the tab so that when the tab engages one edge, the brush 74 is in the downward operative position with the bristle substantially perpendicular to the nozzle openings 32 and 34, and when the tab engages the other edges of the brush it is in the inoperative position with the bristles flat against the inner wall of the access plate and substantially parallel to the nozzle opening. When the tab 108 is moved, the rack 86 rotates the pinion 84 and thus the brush 74 to the selected position.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a vacuum cleaning apparatus comprising a chassis having a suction nozzle including an inlet mouth having a leading edge and a trailing edge at the bottom of the chassis, means for creating sub-atmospheric pressure at the nozzle inlet mouth, an elongated agitator brush mounted for rotation within the nozzle intermediate the leading and trailing edges, and motor means for rotatably driving the agitator brush, the improvement comprising an elongated bare floor cleaning brush having a multiplicity of bristles supported on a frame, said frame including a spindle at each longitudinal end journalled in the nozzle adjacent the trailing edge for rotation between a first position with the bristles substantially perpendicular to the nozzle mouth and a second position wherein the bristles are substantially parallel to the nozzle mouth, a gear having a plurality of circumferentially spaced teeth secured to the spindle on one end, a rack mounted for lateral movement within said chassis and having a plurality of teeth at least some of which are in mesh with cooperating teeth of the gear, a lever journalled in the chassis for rotation about an axis parallel to said spindles, and linking means connected at one end in said lever and at another end to said rack, whereby rotation of said lever effects rotation of said brush to a selected one of said positions.

2. In a vacuum cleaning apparatus as recited in claim 1 including first stop means for limiting the rotational movement of said lever in a first direction corresponding to said first position of said brush, and second stop means for limiting the rotational movement of said lever in a second direction corresponding to said second position of said brush.

3. In a vacuum cleaning apparatus as recited in claim 2 wherein said chassis includes an elongated slot and at least a portion of said lever extends through said slot, said first stop means comprises a margin of said slot at one end and said second stop means comprises the margin of said slot at the opposite end.

* * * * *